United States Patent [19]

DuPont

[11] Patent Number: 4,943,250

[45] Date of Patent: Jul. 24, 1990

[54] ARTICULATED HYDROFOIL OAR

[76] Inventor: Stephen DuPont, 24 N. Casey Key Rd., Osprey, Fla. 34229

[21] Appl. No.: 367,778

[22] Filed: Jun. 19, 1989

Related U.S. Application Data

[63] Continuation-in-part of Ser. No. 252,651, Sep. 30, 1988, Pat. No. 4,867,718, which is a continuation-in-part of Ser. No. 10,585, Feb. 3, 1987, Pat. No. 4,770,821.

[51] Int. Cl.[5] ..... B63B 16/04

[52] U.S. Cl. ..... 440/101; 416/74; 440/102

[58] Field of Search ..... 440/13, 14, 101–105; 416/74, 79–83

[56] References Cited

U.S. PATENT DOCUMENTS

| | | | |
|---|---|---|---|
| 535,584 | 3/1895 | Harbers | 440/103 |
| 1,540,695 | 6/1925 | Howard | 440/103 |
| 2,213,538 | 9/1940 | Whitehead | 440/101 |
| 2,466,351 | 4/1949 | Ankarlo | 440/102 |
| 2,557,972 | 6/1951 | Jewett | 114/363 |
| 2,565,714 | 8/1951 | Anderson | 440/103 |
| 4,622,017 | 11/1986 | McGraw | 440/101 |
| 4,738,643 | 4/1988 | Noggle | 440/103 |

FOREIGN PATENT DOCUMENTS

| | | | |
|---|---|---|---|
| 2452421 | 11/1980 | France | 440/103 |

*Primary Examiner*—Joseph F. Peters, Jr.
*Assistant Examiner*—Edwin L. Swinehart
*Attorney, Agent, or Firm*—John R. Doherty

[57] ABSTRACT

An oar and oarlock arrangement comprising, in combination: a handle loom and a structurally separate blade loom having a hydrofoil blade mounted to its outermost end, the handle loom and blade loom being hinged for sweep action about a rockable oarlock. The handle and blade looms are interconnected by a motion reversing linkage such as a pair of gears, for example. A feathering linkage is provided between the main frame of the oarlock and the hydrofoil blade for changing the angle of attack of the blade in the water.

22 Claims, 4 Drawing Sheets

FIG. 3
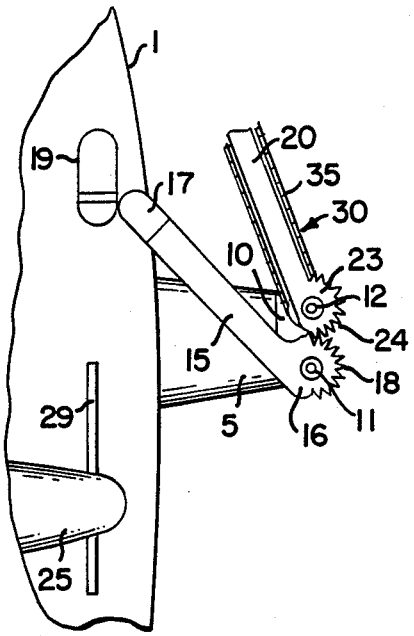
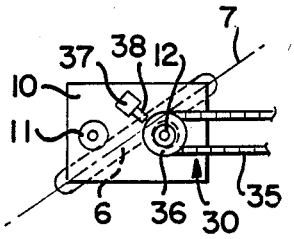
FIG. 5
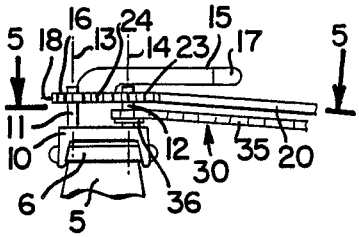
FIG. 4
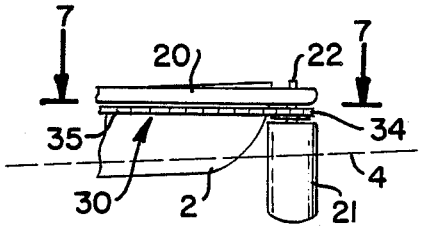
FIG. 6
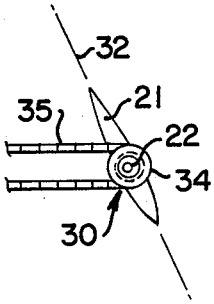
FIG. 7

FIG. 9
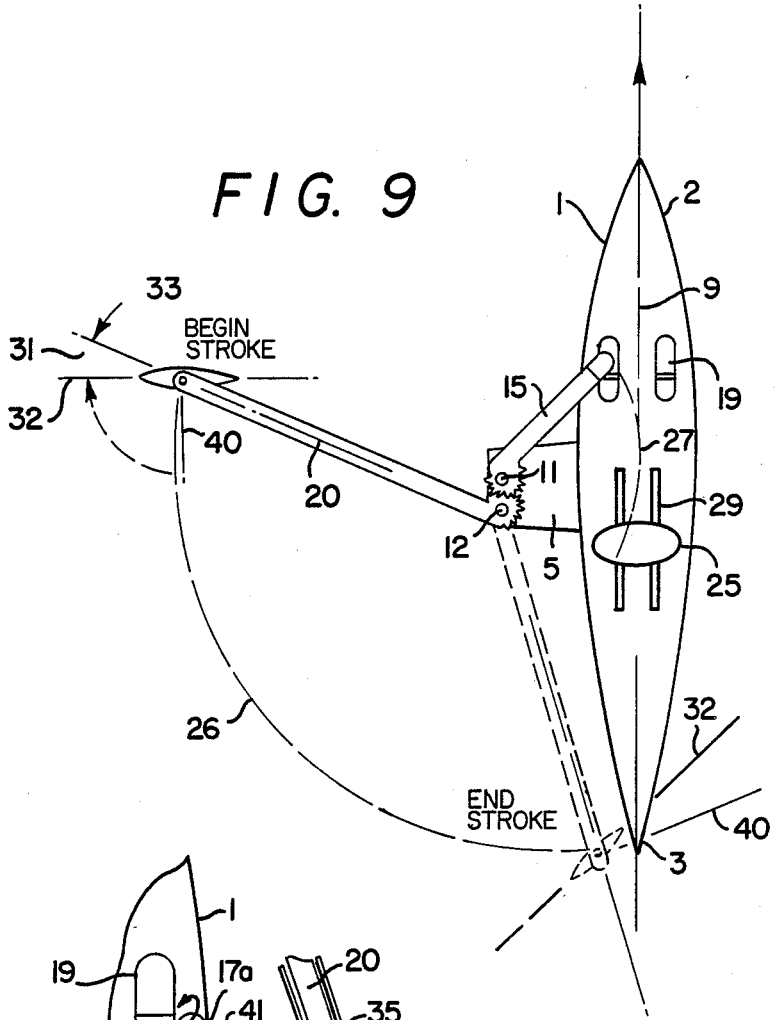
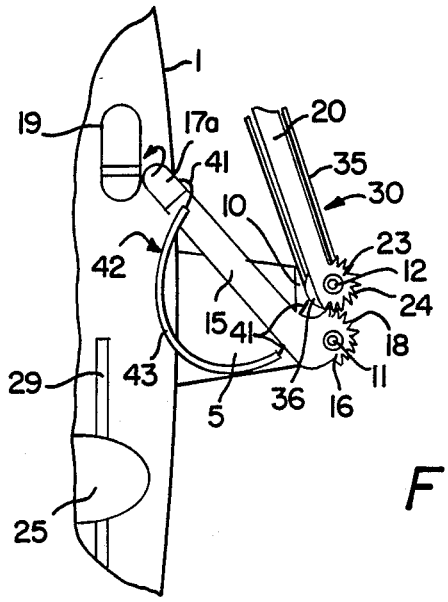
FIG. 8

ARTICULATED HYDROFOIL OAR

This application is a Continuation-in-Part of my earlier filed co-pending application Ser. No. 252,651, filed on Sep. 30, 1988, now U.S. Pat. No. 4,867,718 issued Sep. 19, 1989, which in turn is a Continuation-in-Part of my still earlier filed co-pending application Ser. No. 010,585, filed on Feb. 3, 1987, now U.S. Pat. No. 4,776,821 issued on Oct. 11, 1988.

BACKGROUND OF THE INVENTION

The present invention relates to a rowing apparatus having an oar and oarlock arrangement of improved efficiency.

In my above referred to co-pending application Ser. No. 252,651, there is disclosed and claimed an improved rowing apparatus which can accommodate either a forwards or rearwards facing oarsman and which employs an L shaped oarloom supported at or close to its elbow by a special oarlock and a hydrofoil blade mounted to the outer end of the oarloom. This arrangement results in a predominantly lateral motion to the blade allowing it to produce thrust during the laminar flow regime through the water where the angle of attack of the blade to the water is less than about 16 degrees. An obJection to this arrangement is that in the forwards facing mode during the more forwards moving portion of the finish of the sweep arc as dictated by the L shaped oar, the hydrofoil blade produces thrust which has a highly lateral vector component and therefore produces an inefficient thrust for propulsion of the boat in the forwards direction.

SUMMARY OF THE INVENTION

The oar and oarlock arrangement of the present invention overcomes the lateral thrust component objection for the forwards facing mode by transferring the function of the blade from a lateral moving unstalled hydrofoil thrust producer during the lateral portion of the sweep arc, that is, where the thrust stroke begins well forwards of the oarlock or where the thrust stroke ends well aft of the oarlock, into a fully stalled paddle moving aftwards during that portion of the stroke where the sweep arc moves in a more aftwards direction. The blade thrust thus retains a most forwards direction during the entire thrust sweep.

In order to accomplish this with a forwards facing oarsman seated behind the oars and pulling the oar handles aft during the thrust stroke, the oar arrangement of the present invention comprises a handle loom and a structurally separate blade loom, both of which are hinged for sweep action about a rockable oarlock. The handle and blade looms are interconnected by a motion reversing linkage means such as a pair of gears or a cross chain and sprocket arrangement, for example. A linkage means may also be provided between the main frame of the oarlock and the blade mounted at the end of the blade loom. This linkage serves to control the changing incidence between the blade chordal centerline and the blade loom centerline during the changing sweep arc. The linkage may also include means connecting the linkage at the oarlock to a lever or other control member convenient to the oarsman for adjustment of the blade incidence or angle of attack.

In the case where the sweep arc of the blade starts its stroke well forwards of the oarlock and finishes its stroke close to the lateral position related to the oarlock, either ahead or aft of the oarlock, or the case where the stroke begins in the more lateral position ahead or aft of the oarlock and finishes well aft of the oarlock during the lateral moving portion of the sweep arc, in either case, the blade acts as an unstalled hydrofoil having an angle of attack in its motion related to the water of less than about 16 degrees. Moreover, in both of the above cases, where the sweep arc operates in the less lateral and more backwards motion, the angle of attack is slaved by the linkage means to gradually change between that of a laminar flow unstalled hydrofoil having an angle of attack of less than about 16 degrees and that of a highly stalled turbulant flow paddle with an angle of attack as much as about 90 degrees or more.

The thrust produced by the hydrodynamic "lift" of the laterally moving unstalled hydrofoil is generally normal to the motion of the hydrofoil blade through the water resulting in a highly forwards thrust vector direction, whereas during the more aftwards portion of the motion of the sweep arc, the thrust is more nearly alligned with and opposite in sign to the backwards motion being produced mostly from the drag of the stalled regime of the paddle. Both portions of the thrust stroke arc motion therefore produce a most forwards orientation of the thrust vector throughout the entire thrust stroke.

BRIEF DESCRIPTION OF THE DRAWINGS

The present invention will now be described in greater detail with particular reference to the accompanying drawing wherein like numerals refer to the same or similar parts and wherein:

FIG. 3 is an enlarged plan view of the rowing apparatus of FIG. 1 showing the sweep hinge members in greater detail;

FIG. 4 is an enlarged elevational view of the rowing apparatus of FIG. 1 showing the teeter hinge and sweep gear sectors in greater detail;

FIG. 5 is an enlarged plan view of the rowing apparatus taken along the line 5—5 in FIG. 4;

FIG. 6 is an enlarged elevational view of the rowing apparatus of FIG. 1 showing the blade loom, hydrofoil blade and linkage means in greater detail;

FIG. 7 is an enlarged plan view taken along the line 7—7 in FIG. 6;

FIG. 8 is a view similar to FIG. 3 showing a modification of the rowing apparatus of the invention;

FIG. 9 is a view similar to FIG. 1 showing another embodiment of the rowing apparatus of the invention;

DESCRIPTION OF THE PREFERRED EMBODIMENTS

Figure 1:
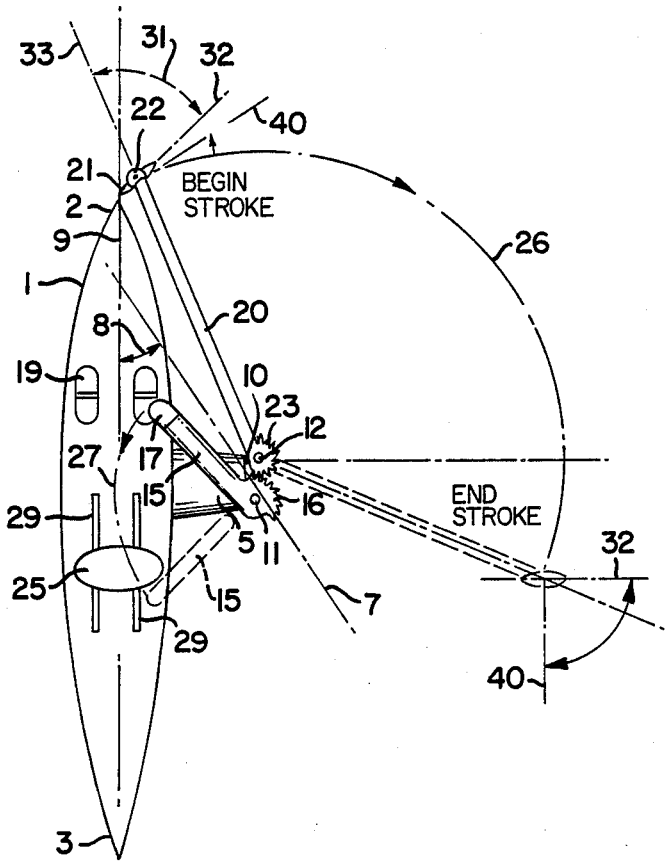
FIG. 1 is a plan view of a boat and bow facing rowing apparatus according to one embodiment of the invention.
Figure 2:
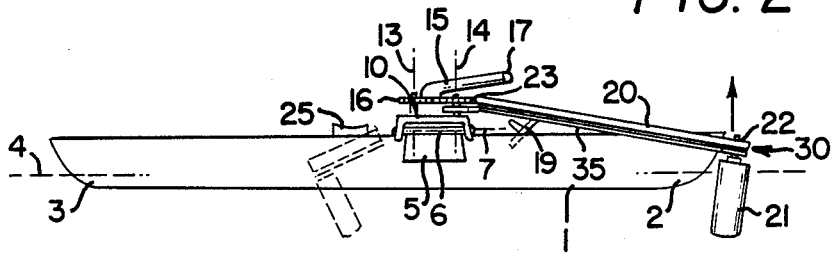
FIG. 2 is an elevational view of the boat and rowing apparatus of FIG. 1.

The general arrangement of a shell equipped with a bow facing rowing apparatus according to one embodiment of the present invention is shown in FIG. 1–7, wherein the numeral 1 is the hull of the shell having fore and aft ends 2 and 3, respectively, 4 is the water line and 5 is one of a pair of outriggers extending laterally from each side of the hull. Although only one of the outriggers is shown along with its associated rowing apparatus for purposes of simplicity, it will be understood that both outriggers and rowing apparatus are identical in construction and design.

An oarlock teeter hinge 6 is mounted to the outer end of the outrigger 5 and has its horizontal axis lying in a generally vertical plane 7 fore and aft to the boat hull 1 and preferably converging at an angle 8 towards the centerline 9 of the hull. An oarlock main frame 10 is fastened to the mating teeter hinge 6 at the outer end of the outrigger 5 and carries two sweep hinge pins 11 and 12. The sweep hinge pins 11 and 12 are mounted on two separate parallel vertical axis 13 and 14 and are rockable with the oarlock main frame 10 about the teeter hinge 6.

An elongated handle loom 15 is provided and has affixed to its outer end a sweep hinge member 16 which is rotatable about the axis of the hinge pin 11. The handle loom 15 lies approximately athwartship at midstroke and has a handle 17 at its inboard end. The sweep hinge member 16 carries at its outermost surface a vertical axis gear sector 18 which is centered about the axis of the pin 11.

A separate, elongated blade loom 20 is also provided and has mounted below its outer end a blade 21 having a generally hydrofoil shape. The blade 21 is rotatable about the axis of a feathering pin 22 which is secured to the outer end of the blade loom 20.

In the embodiment of the invention illustrated in FIGS. 1 1–7, the blade loom 20 lies fore and aft of the boat hull 1 and ahead of the oarlock main frame 10 at the beginning of the thrust stroke. At the finish of the stroke, the blade loom 20 is disposed generally lateral to the hull 1 and ahead or aft of the oarlock main frame 10.

At its oarlock end, the blade loom 20 has a sweep hinge member 23 which is rotatable about the axis of the sweep hinge pin 12. The sweep hinge member 23 similarly carries at its outer surface a vertical axis gear sector 24 which is centered about the axis of the pin 12.

As shown in FIG. 3, the gear sector 18 on the sweep hinge member 16 engages and mates with the gear sector 24 on the sweep hinge member 23. Thus, when an oarsman seated facing forwards on the seat 25 pulls the handle loom 15 rearwardly in a counter-clockwise direction about the hinge pin 11, the blade loom 20 is caused to move clockwise along with the hydrofoil blade 21 about the hinge pin 12. The blade loom 20 will move through an angle the size of which is dependent upon the ratio relationship between the respective gear sectors 18 and 24. The oar assembly is constructed and arranged in the preferred embodiments so that the sweep angle of the blade loom 20 is always larger than that of the handle loom 15. This is achieved by employing a gear pitch radius for the handle loom gear sector 18 which is larger than that of the gear sector 24. The exact pitch ratio to be employed in a given case can be determined experimentally. Preferably, the two gear sectors 18 and 24 are constructed and arranged so as to produce a sweeping motion of the blade loom 20 through an arc 26 of 90 degrees more or less when the handle loom 15 is rotated through an arc 27 of less than 90 degrees.

The seat 25 is movable longitudinally along the hull 1 on rollers (not shown) which are guided by tracks 29. The seat 25 is located well behind the oarlock main frame 10 so as to allow the handle loom 15 to swing fully through its arc 27 during the power stroke. The oarsman faces forwards with his feet in the foot restraints or stretchers 19.

An important feature of the invention resides in the oarlock teeter hinge 6 having its generally vertical plane 7 lying outboard of the handle 17 and inboard of the blade 21 each to their respective sweep hinge line. This arrangment allows lifting the blade 21 from the water by depressing the handle 17 downwardly.

A linkage 30 is provided between the oarlock main frame 10 and the blade 21 for changing the angle of incidence 31 between the chordal plane 32 of the blade and the centerline 33 of the blade loom 20. As best illustrated in FIGS. 4–7, the linkage 30 includes a sprocket 34 which is affixed to the top of the blade 21 and which is rotatable mounted about the pin 22 and a continuous chain link 35. The chain link 35 extends longitudinally beneath the blade loom 20 to the oarlock main frame 10 where it engages another sprocket 36 rotatably mounted about the hinge pin 12.

An adjustable restraint 37 is mounted to the oarlock main frame 10 and includes a locking pin 38. The pin 38 is adapted to move into engagement with the sprocket 36 and lock it in place against rotation.

Figure 11:
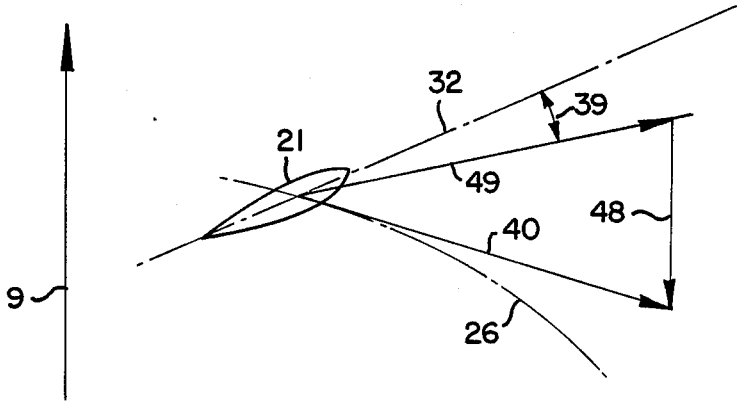
FIG. 11 is a vector diagram establishing blade angle of attack.

During the laterally moving portion of the sweep arc 26, the blade 21 acts as an unstalled hydrofoil having an angle of attack of less than about 16 degrees as shown at 39 in FIG. 11. The angle of attack is the angle between the chordal plane 32 and the resultant vector 49 derived from the relative water motion vector 48 and the blade velocity vector 40. The thrust produced is generally normal to the resultant vector 49, resulting in a highly forwards thrust vector direction.

As the blade loom 20 sweeps outwardly through its arc 26 in a less lateral and more backwards motion, the sprocket 34 rotates slowly about the axis of the pin 22 due to the changing orientation of the chain link 34 as the chain is pulled around the locked sprocket 36. Rotation of the sprocket 34 in the manner described causes the blade 21 to gradually change its mode of operation from that of a laminar flow, unstalled hydrofoil having an angle of attack of less than about 16 degrees to a highly stalled turbulent flow paddle having an angle of attack of about 90 degrees or more. The thrust produced by the highly stalled hydrofoil blade 21 during the backwards moving portion of the arc 26 is substantially aligned with but opposite to the aftwards motion of the blade.

Thus, it will be seen that during both the lateral and backwards portions of the sweep arc 26, the hydrofoil blade 21 produces a thrust which is oriented primarily in the forward direction throughout the thrust stroke. The rowing apparatus of the invention is therefore significantly more efficient than similar apparatus of the prior art.

The linkage 30 may also include means for adjusting or setting the hydrofoil blade 21 to a desired angle of attack at any time during the rowing operation. Thus, as shown in FIG. 8, the handle loom 15 may include at its inboard end a rotatable handle **17*a* similar to that used, for example, on a motorcycle to throtle its engine. A flexable cable 42 extends between the handle 17*a* and the sprocket 36. The cable 42 includes an outer sleeve 43 encasing a movable control wire 41, the sleeve being anchored at the inboard end and at the outboard end to the handle loom 15 oarlock main frame 10. The control wire 41 links the handle 17*a* to the blade 21 via the chain link 35. The oarsman can orientate the blade 21 to any specific angle of attack while remaining on the seat 25** by simply rotating the handle 17*a*. The handle 17*a* may also include a locking member such as a ratchet, for example, to lock the sprocket 36 in place and prevent its rotation. In such case, the restraint 37 on the oarlock main frame 10 may be eliminated.

FIG. 9 illustrates another embodiment of the invention wherein the blade loom 20 is disposed generally lateral to the boat hull 1 and ahead or aft of the oarlock main frame 10 at the beginning of the thrust stroke. At the finish of the stroke, the blade loom 20 lies fore and aft of the hull 1 and behind the oarlock main frame 10. The rowing apparatus of this embodiment is basically the same as that described above except that the linkage 30 (not shown in FIG. 9) changes the mode of operation of the blade 21 at the beginning of the stroke from that of a highly stalled turbulent flow paddle having an angle of attack of about 90 degrees or more to a laminar flow, unstalled hydrofoil having an angle of attack of less than about 16 degrees at the finish of the stroke.

Figure 10:
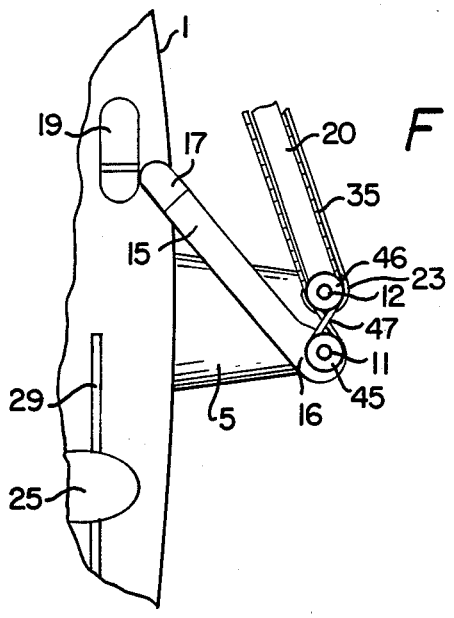
FIG. 10 is a view similar to FIG. 3 showing still another embodiment.

A number of modifications of the rowing apparatus of the invention are of, course, possible. As shown in FIG. 10, for example, the motion reversing linkage employed between the handle loom 15 and the blade loom 20 may be composed of pair of drums 45, 46, one of each of which is affixed to one of the sweep hinge members 16, 23 and a flexible cross cable 47. The cross cable 47 is wrapped around each drum 45, 46 in a figure-eight configuration so that when the handle loom 15 is pulled backwards, the drum 45 will rotate along with the sweep hinge member 16 and impart an opposite rotation to the drum 46 on the sweep hinge member 23. It will be apparent that other similar arrangements may be employed for the reversing linkage such as, for example, two sprockets and a cross chain as well as end hinged link rods and the like. Other arrangements for the feathering linkage 30 can also be employed such as two levers and a connecting link rod and again a pair of drums and a connecting cable replacing the two sprocket 34 and 36 and the continuous chain 35. FIG. 11 is a velocity vector diagram establishing blade angle of attack where vector 48 is relative water velocity and vector 49 is resultant blade velocity through the water.

The rowing apparatus of the present invention has been described herein with particular reference to forward facing rowing as shown in FIGS. 1–3 and FIG. 8. However, the invention is not so limited and may be practiced as well with rearward facing rowing wherein the oarsman's seat is located ahead of the handle looms with the oarsman's body facing rearwards toward the aft end of the hull. Again, the blade looms may be disposed fore and aft of the hull leading the oarlock main frame 10 at the beginning of the thrust stroke and lateral to the hull at the finish of the stroke or they may be disposed lateral to the hull at the beginning of the stroke and fore and aft of the hull trailing the main frame 10 at the finish of the stroke. The various arrangement for the forwards and rearwards facing oarsman are disclosed fully in my above referred to co-pending application Ser. No. 252,651 of which this application is a Continuation-in-Part and which are incorporated herein by reference.

What is claimed is:

1. A rowing apparatus comprising, in combination: a boat having a hull with fore and aft ends and having an outrigger projecting laterally outwards from each side of said hull, and at least two oar assemblies located one on each side of said hull, each of said oar assemblies comprising a handle loom having a generally athwartship position at mid-stroke and having an inboard end and an outboard end located at said outrigger, a blade loom extending outwardly from said outrigger and having an outer end and an inner end also located at said outrigger, an oarlock teeter hinge member mounted onto said outrigger and adapted to rotate about a substantially horizontal axis, a first sweep hinge member affixed to said outboard end of said handle loom, a second sweep hinge member affixed to said inner end of said blade loom, means for rotatably mounting said first and said second sweep hinge members onto said oarlock teeter hinge member, means associated with said first and second teeter hinge members for transferring the motion of said handle loom to said blade loom while at the same time reversing the direction thereof, and a blade having a hydrofoil shaped surface mounted to and below said outer end of said blade loom, said blade lying in a generally vertical plane and defining with said blade loom an angle of incidence therebetween, the arrangement being such that when said handle loom is rotated during the thrust stroke, said blade moves in a sweep arc through the water floating said hull in a direction opposite to the motion of said handle loom, said blade traveling in a substantially lateral direction with respect to said hull over a portion of said sweep arc, the angle of incidence between said blade and said blade loom being such that said blade acts as a laminar flow, unstalled hydrofoil having an angle of attack with respect to its movement through the water which will produce a thrust generally normal to the direction of motion of said hydrofoil surface during said lateral moving portion of said sweep arc.

2. A rowing apparatus according to claim 1, further including means associated with said blade loom for automatically changing said angle of incidence of said blade while said blade moves in said sweep arc from the beginning of said thrust stroke to the finish of said thrust stroke.

3. A rowing apparatus according to claim 2, further including means associated with said handle loom for manually adjusting said angle of incidence of said blade during operation of said rowing apparatus.

4. A rowing apparatus according to claim 2, wherein said blade loom lies generally fore and aft to said boat hull at the beginning of said thrust stroke and generally lateral to said hull at the finish of said thrust stroke.

5. A rowing apparatus according to claim 4, wherein said blade loom leads said oarlock teeter hinge member at the beginning of said thrust stroke.

6. A rowing apparatus according to claim 4, wherein said blade loom trails said oarlock teeter hinge member at the beginning of said thrust stroke.

7. A rowing apparatus according to claim 2, wherein said blade loom lies generally lateral to said boat hull at the beginning of said thrust stroke and generally fore and aft to said hull at the finish of said thrust stroke.

8. A rowing apparatus according to claim 7, wherein said blade loom leads said oarlock teeter hinge member at the finish of said thrust stroke.

9. A rowing apparatus according to claim 7, wherein said blade loom trails said oarlock teeter hinge member at the finish of said thrust stroke.

10. A rowing apparatus according to claim 1, wherein the sweep angle of said blade loom as it moves through its arc is larger than the sweep angle of said handle loom.

11. A rowing apparatus according to claim 1, wherein the handle loom has a handle at its inboard end and wherein the horizontal axis of said oarlock teeter hinge member lies in a vertical plane which is outboard of said handle and inboard of said blade.

12. A rowing apparatus according to claim 2, wherein said means for automatically changing said angle of incidence of said blade comprises a first sprocket mounted for rotation about a pin located at said outer end of said blade loom, said first sprocket being connected to said blade, a second sprocket mounted for rotation about a hinge pin located on said oarlock teeter hinge member, a continuous chain link connecting said first and second sprockets and means for locking said second sprocket against rotation.

13. A rowing apparatus according to claim 3, wherein said means for manually adjusting said angle of incidence of said blade comprises a handle rotatably mounted onto said inboard end of said handle loom and a linkage extending between said handle and said blade loom, said linkage connecting said handle and said incidence angle changing means whereby the orientation of said blade with respect to said blade loom may be changed by rotating said handle.

14. A rowing apparatus according to claim 13, wherein said means for changing said angle of incidence of said blade comprises a first sprocket mounted for rotation about a pin located at said outer end of said blade loom, said first sprocket being connected to said blade, a second sprocket mounted for rotation about a hinge pin located on said oarlock teeter hinge member and a continuous chain link connecting said first and second sprockets and wherein said linkage extending between said handle and said blade loom connects said handle with said second sprocket for moving said sprocket when said handle is rotated.

15. A rowing apparatus according to claim 1, wherein said means for transferring the motion of said handle loom to said blade loom comprises a first gear sector on said first sweep hinge member and a second gear sector on said second sweep hinge member, said first and second gear sectors engaging and mating with one another in a manner whereby movement of said handle loom in one direction will cause movement of said blade loom in an opposite direction.

16. A rowing apparatus according to claim 1, wherein said means for transferring the motion of said handle loom to said blade loom comprises a first drum mounted on said first sweep hinge member, a second drum mounted on said second sweep hinge member and a cross cable connecting said first and second drums in a manner whereby movement of said handle loom in one direction will cause movement of said blade loom in an opposite direction.

17. A rowing apparatus according to claim 1, wherein said means for transferring the motion of said handle loom to said blade loom comprises a first sprocket mounted on said first sweep hinge member, a second sprocket mounted on said second sweep hinge member and a cross chain connecting said first and second sprockets in a manner whereby movement of said handle loom in one direction will cause movement of said blade loom in an opposite direction.

18. A rowing apparatus according to claim 5, further including a seat located aft of said handle loom for a forwards facing oarsman, said seat being mounted on tracks for movement longitudinally along said hull.

19. A rowing apparatus according to claim 4, wherein said blade has an angle of attack of less than about 16 degrees in respect to its movement through the water at the beginning of said thrust stroke and an angle of attack of 90 degrees or more at the finish of said stroke.

20. A rowing apparatus according to claim 7, wherein said blade has an angle of attack of 90 degrees or more in respect to its movement through the water at the beginning of said thrust stroke and an angle of attack of less than about 16 degrees at the finish of said stroke.

21. A rowing apparatus comprising, in combination: a boat having a hull with fore and aft ends and having an outrigger projecting laterally outwards from each side of said hull, and at least two oar assemblies located one on each side of said hull, each of said oar assemblies comprising a handle loom having a generally athwartship forgot line position at mid-stroke and having an inboard end and an outboard end located at said outrigger, a blade loom extending outwardly from said outrigger and having an outer end and an inner end also located at said outrigger, an oarlock teeter hinge member mounted onto said outrigger and adapted to rotate about a substantially horizontal axis, a first sweep hinge member affixed to said outboard end of said handle loom, a second sweep hinge member affixed to said inner end of said blade loom, means for rotatably mounting said first and said second sweep hinge members onto said oarlock teeter hinge member, means associated with said first and second teeter hinge members for transferring the motion of said handle loom to said blade loom while at the same time reversing the direction thereof, a blade having a hydrofoil shaped surface mounted to and below said outer end of said blade loom, a first sprocket rotatably mounted to said outer end of said blade loom, said first sprocket being connected to said blade, a second sprocket rotatably mounted to said oarlock teeter hinge member, a continuous chain link connecting said first and second sprockets, and means for locking said second sprocket against rotation, the arrangement being such that said blade moves in a sweep arc through the water floating said hull in a direction opposite to the motion of said handle loom and at an automatically changing angle of incidence between said blade and said blade loom whereby the angle of attack of said blade with respect to its movement through the water will produce a thrust generally normal to the direction of motion of said hydrofoil surface.

22. A rowing apparatus comprising, in combination: a boat having a hull with fore and aft ends and having an outrigger projecting laterally outwards from each side of said hull, and at least two oar assemblies located one on each side of said hull, each of said oar assemblies comprising a handle loom having a generally athwartship position at mid-stroke and having an inboard end and an outboard end located at said outrigger, a blade loom extending outwardly from said outrigger and having an outer end and an inner end also located at said outrigger, an oarlock teeter hinge member mounted onto said outrigger and adapted to rotate about a substantially horizontal axis, a first sweep hinge member affixed to said outboard end of said handle loom, a second sweep hinge member affixed to said inner end of said blade loom, means for rotatably mounting said first and said second sweep hinge members onto said oarlock teeter hinge member, means associated with said first and second teeter hinge members for transferring the motion of said handle loom to said blade loom while at the same time reversing the direction thereof, a blade having a hydrofoil shaped surface mounted to and below said outer end of said blade loom, a first sprocket rotatably mounted to said outer end of said blade loom, said first sprocket being connected to said blade, a second sprocket rotatably mounted to said oarlock teeter hinge member, a continuous chain link connecting said first and second sprockets, a handle rotatably mounted onto said inboard end of said handle loom and a linkage extending between said handle and said blade loom, said linkage connecting said handle with said second sprocket for moving said sprocket when said handle is rotated, the arrangement being such that said blade moves in a sweep arc through the water floating said hull in a direction opposite to the motion of said handle loom and at an automatically changing angle of incidence between said blade and said blade loom whereby the angle of attack of said blade with respect to its movement through the water will produce a thrust generally normal to the direction of motion of said hydrofoil surface.

* * * * *